United States Patent [19]

Gilmore

[11] Patent Number: 4,743,175

[45] Date of Patent: May 10, 1988

[54] REEL ASSEMBLY FOR DEWATERING APPARATUS

[75] Inventor: Alfred L. Gilmore, North Mackay, Australia

[73] Assignee: Legra Engineering Pty. Ltd., Queensland, Australia

[21] Appl. No.: 769,011

[22] Filed: Aug. 23, 1985

[30] Foreign Application Priority Data

Mar. 15, 1984 [AU] Australia ..... PG4100

[51] Int. Cl.[4] ..... E21B 43/00

[52] U.S. Cl. ..... 417/361; 417/375; 166/77; 166/85; 226/188; 226/189

[58] Field of Search ..... 166/77, 85, 385, 68; 226/108, 168, 188, 189; 417/361, 375, 392

[56] References Cited

U.S. PATENT DOCUMENTS 2,262,364 11/1941 Hugel et al. ..... 166/77
3,363,880 1/1968 Blagg ..... 166/77 X
3,841,407 10/1974 Bozeman ..... 166/77 X
4,416,329 11/1983 Tanner et al. ..... 166/385 X
4,476,945 10/1984 Hearn ..... 175/220 X
4,589,061 4/1986 Lyons, Jr. et al. ..... 166/77

*Primary Examiner*—Carlton R. Croyle
*Assistant Examiner*—Theodore Olds
*Attorney, Agent, or Firm*—Wood, Dalton, Phillips, Mason & Rowe

[57] ABSTRACT

A dewatering pump assembly including a rotatably supported reel about which a flexible conduit is wound and which passes from the reel through a driven roller assembly to be attached at one end to a hydraulically driven pump assembly which is lowered into a bore hole or the like. Hydraulic supply and exhaust lines pass through the conduit to the hydraulic motor of the pump assembly and the driven roller assembly includes a plurality of pairs of cooperating rollers arranged to arcuately bend the conduit and direct the conduit between the bore hole and the reel.

9 Claims, 4 Drawing Sheets

REEL ASSEMBLY FOR DEWATERING APPARATUS

THIS INVENTION relates to apparatus for removing water or other liquids from bore holes such as blast holes, foundation holes or for other sub-surface applications.

Dewatering pump sets are primarily used for pumping water or other liquid from ground bores and for this purpose, such pump sets often comprise an hydraulically driven pump having its outlet connected to one end of a flexible conduit which is lowered into the ground bore so that the pump becomes submerged in the water or liquid therein so that when operating, it can pump liquid or water from the bore and through the flexible conduit for discharge at ground level. U.S. Pat. No. 3,702,223 to D. H. Bednar discloses a pump set of the above type wherein the discharge conduit and hydraulic supply lines for the pump motor are encased within a sheathing cable which is wound about a rotatable reel assembly which may be driven in opposite directions to lower or raise the pump. A disadvantage of this arrangement however is that difficulties are encountered in ensuring that the pump and sheathing cable pass freely down the bore hole. These difficulties are accentuated by the configuration of the hydraulic lines, discharge conduit and sheathing cable employed. Furthermore the depth of operation of such pump sets in some situations is limited because of heat build-up in the hydraulic lines. The above disclosed arrangement also encounters difficulties in the transfer of hydraulic fluid to the inlet and outlet hydraulic fluid lines for the pump motor.

The present invention aims to overcome or alleviate at least some of the above disadvantages by providing apparatus for removing water or other liquids from bore holes, foundation holes or any other situations incorporating an improved feed arrangement for feeding the pump of the apparatus and its associated discharge conduit or hose down a bore hole or the like. The present invention also aims to provide an improved means for preventing excessive heat build-up in the hydraulic supply and discharge lines for the pump motor and also provides improved means for transferring hydraulic fluid to and from the supply and discharge lines at ground level.

With the foregoing and other objects in view, this invention resides broadly in apparatus for removing water or other liquid from bore holes or the like including a reel assembly for supporting flexible discharge conduit means, said conduit means communicating at one end with pump means, said reel assembly being arranged to be rotated in use so that said pump means and conduit means may be lowered into said bore hole or raised therefrom and there being provided driven roller means operatively engaged with said conduit means and adapted to guide said conduit means between said reel assembly and said bore hole, said roller means being further operative to at least assist in unwinding of said conduit means from said reel assembly for lowering said pump assembly into said bore hole.

In a further aspect, the invention resides broadly in apparatus for removing water or other liquid from bore holes or the like including a reel assembly for supporting flexible discharge conduit means, said conduit means communicating at one end with pump means, said reel assembly being arranged to be rotated in use so that said pump means and conduit means may be lowered down said bore hole or raised therefrom, hydraulic motor means operatively coupled to said pump means to drive the latter in use so that water or other liquid in said bore hole may be delivered by said pump means into said conduit means for discharge and there being provided hydraulic fluid supply and discharge pipes coupled to said hydraulic motor means, said pipes being arranged within said discharge conduit means and extending therealong.

In order that the invention may be more readily understood and put into practical effect, reference will now be made to the accompanying drawings which illustrate a preferred embodiment of the invention and wherein.

Figure 2:
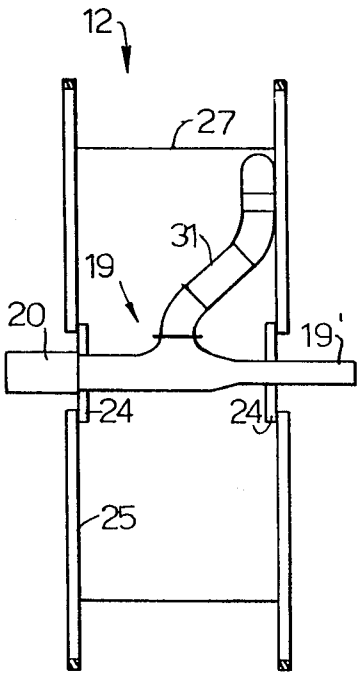
FIG. 2 is an end elevational view of the hose reel of the pump set.

Referring to the drawings and firstly to FIGS. and 2, there is illustrated a dewatering pump set 10 according to the present invention including a frame assembly 11 for supporting a driven hose reel 12 about which is wound a flexible discharge hose or conduit 13 which extends through an adjustable driven roller assembly 14 and communicates with a submersible pump assembly 15, the latter in use being lowered into a bore hole, foundation hole or the like, to pump out water or liquid through the hose 13. The frame assembly 11 includes respective front and rear rectangular frames 16 interconnected by upper and lower frame members 17. The frame assembly 11 also includes a pair of braced diagonally extending support arms 18 which are operative to support the hose reel 12.

Figure 1:
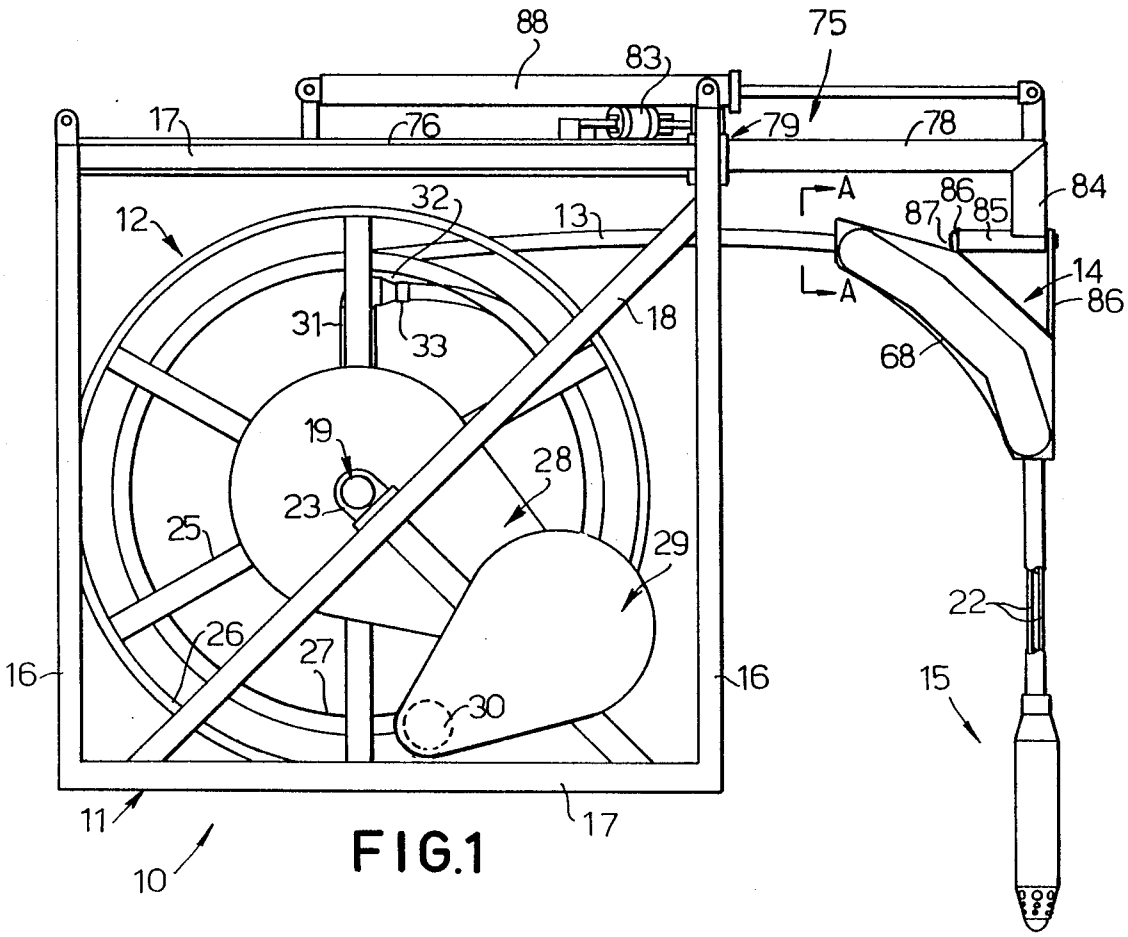
FIG. 1 is a side elevational view of the pump set incorporating improvements in accordance with the present invention.

As shown in FIGS. 1 and 2, the hose reel 12 includes a hollow axle assembly 19 which supports at one end a gland assembly 20 which is operative to permit the feed and exhaust of hydraulic fluid to and from the hydraulic motor 21 of the pump assembly 15 via flexible pipes 22 which extend along the length of the hose 13 so as to communicate with the pump motor 21. The gland assembly 20 is supported on one of the diagonal arms 18 and acts also as a bearing to support one end of the axle assembly 19 while the opposite end 19' of the axle assembly 19 which is open and defines a discharge port for water or liquid from the bore hole is supported on the opposite diagonal arm 18 by a bearing 23. Respective hubs 24 are fixed to the hollow axle assembly 19 and a plurality of spokes 25 extend radially therefrom to be connected at their free ends to respective annular rims 26. Extending and supported between the respective sets of spokes 25 is a member 27 which defines a cylindrical support surface about which the hose 13 may be wound.

A gear wheel or pulley comprising part of a reduction assembly 28 is fixed coaxially to the open end 19' of the axle assembly and the reduction assembly 28 communicates via a further reduction assembly 29 with a hydraulic motor 30 so that the reel 12 can be driven at a desired rate.

Figures 3, 4, 5:
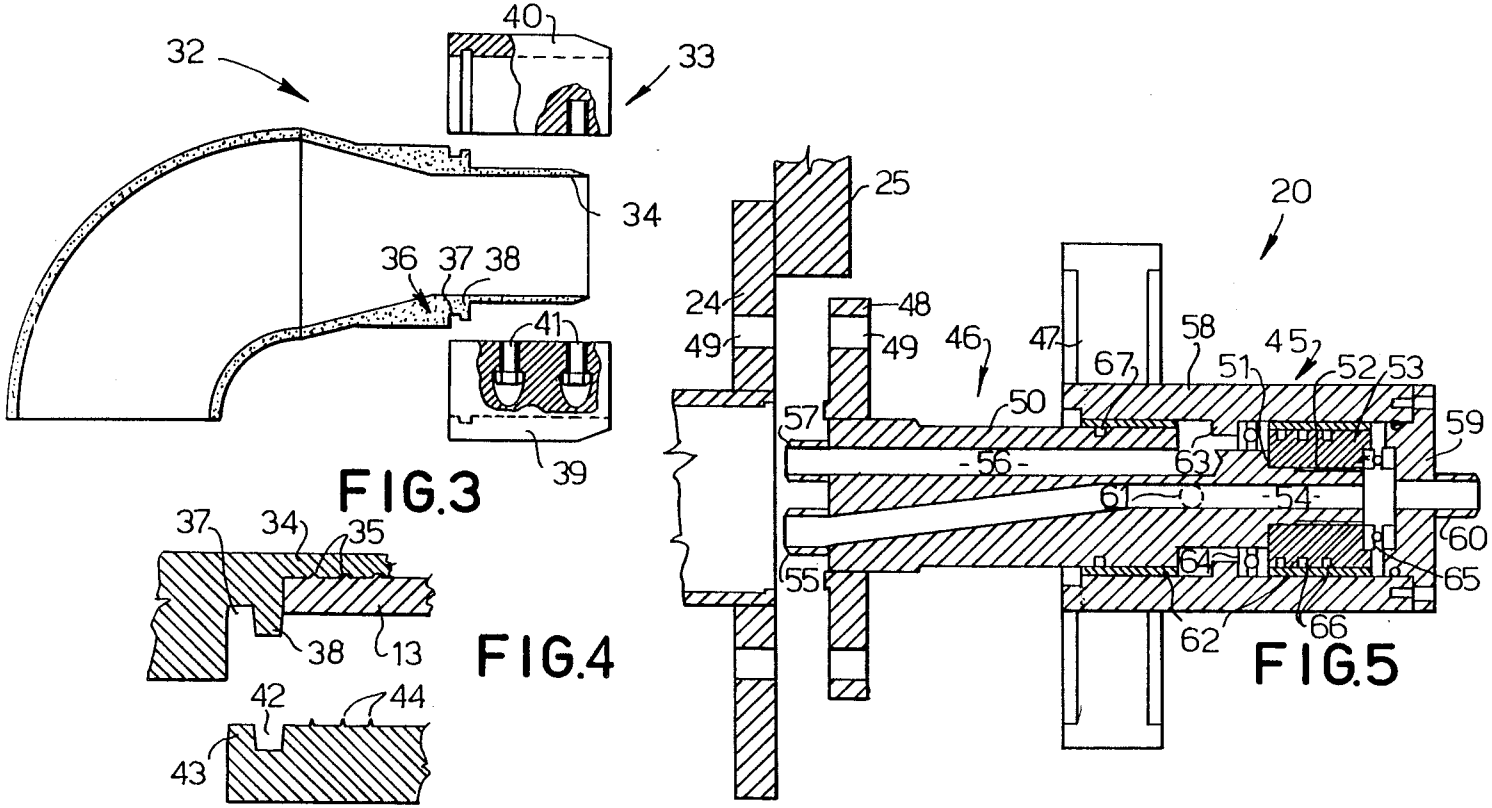
FIG. 3 illustrates in sectional view details of the connection assembly between the hose and the reel axle assembly.
FIG. 4 is an enlarged sectional view showing further details of the connection assembly.
FIG. 5 is a cross-sectional view illustrating the gland assembly for the feeding and exhaust of hydraulic fluid to and from the pump.

The axle assembly 19 also communicates with a radially extending pipe 31 which extends outwardly to adjacent the cylindrical wall 27 and is connected with one end of the flexible pipe 13 which passes through the wall 27. For this purpose, the free end of the pipe 31 is provided with a connection portion 32 and a clamp assembly 33 shown more clearly in FIGS. 3 and 4 is arranged to clamp the flexible pipe to the connection portion 32. For this purpose, the connection portion 32 of the pipe 31 tapers to a leading tubular portion 34 which is inserted into the end of the hose 13 and which is provided with a plurality of annular grooves 35 in its outer surface the purpose of which will hereinafter become apparent. Disposed rearwardly of the tubular portion is an enlarged shoulder portion 36 provided with an annular locating groove 37 which defines an annular projection 38. The clamp assembly 33 is of generally annular form comprising two similar parts 39 and 40 which are arranged to be clamped together by means of bolts 41 which in use pass through aligned holes in the clamp parts 39 and 40. The clamping parts 39 and 40 when assembled define on their inner surface an annular groove 42 arranged in use to receive the annular projection 38 on the connection portion 32 in the manner shown in FIG. 4. The annular groove 42 also defines an annular projection 43 which is arranged to be received in the groove 37. The inner surfaces of the clamping parts 39 and 40 are also provided with a plurality of annular gripping projections 44 which are spaced apart the same distance as the distance between the grooves 35 in the tubular portion 34. In use, the end of the flexible pipe 13 is engaged over the tubular portion 34 and the clamp parts 39 and 40 placed therearound and clamped together by the bolts 41 so that the respective annular projections and grooves on the clamp parts 39 and 40 and connecting portion 32 will interengage to prevent detachment of the pipe 13. Furthermore, the co-operation between the respective projections 44 and grooves 35 on the clamp parts 39 and 40 and the tubular portion 34 respectively will ensure good sealing of the flexible hose to the connection portion 32.

As stated above, the gland assembly 20 is operative to permit the feed of hydraulic fluid to the pump assembly 15 and exhaust of fluid therefrom during operation of the apparatus and as shown in FIG. 5, the gland assembly 20 includes an outer part 45 which is mounted on one of the diagonal arms 18 and an inner part 46 which is fixed to one end of the axle assembly 19 and supported rotatably within the outer part 45. For this purpose, the outer part 45 includes a flange portion 47 which in use is bolted to one arm 18 whilst the inner part 46 is provided with an annular flange 48 adjacent one end which is adapted to be fixed to one hub 24 of the hose reel 12 by bolts through the aligned holes 49.

As shown in FIG. 5, the body portion 50 of the inner gland part 46 is substantially solid and stepped inwardly at 51 and provided with a threaded end portion 52 for threaded co-operation with an annular end member 53. A first passage 54 extends from one end of the body portion 50 and centrally part way therealong whereafter it extends out at an acute angle to the axis of the body portion 50 to communicate with an hydraulic hose fitting 55. A second passage 56 extends substantially longitudinally of the body portion 50 from a further fitting 57 to open through the side wall of the body portion adjacent the stepped portion 51 thereof.

The outer part 45 of the gland includes a generally hollow cylindrical body 58 open at one end to receive the inner part 46 and adapted to be closed at its other end by a removable end cap 59 provided with an hydraulic fitting 60. The body 58 is also provided with a further fitting 61 which communicates with the interior of the body 58 adjacent the stepped portion 51 of the inner part 45. The body 58 is also fitted with bushings 62 to support the inner part 46 and is further provided with an internal annular bearing shoulder 63.

To assemble the gland 20 the end cap 59 of the outer part 45 is removed as is the end member 53 of the inner part 46. The inner part 46 is then inserted into the outer part 45 and a thrust bearing 64 is engaged over the inner part 45 and forced therealong until it abuts the internal shoulder 63 formed in the outer part. The end member 53 may then be screw engaged with the threaded end 52 of the inner part and is tightened so that the bearing 64 is forced against the shoulder 63. For this purpose, the end member 53 may be provided with a pair of diametrically opposed holes in its outer face to facilitate spanner engagement. Furthermore, a set screw may be provided to lock the end member 53 to the body part 50. A further bearing 65 is then located between the end member 53 and end cap 59 which is re-engaged with the body 58. To ensure proper sealing, the end member 53 is provided with a plurality of grooves 66 to receive sealing rings whilst the body part is provided with a similar groove 67 for this purpose.

The hose fitting 57 is coupled to one of the hydraulic hoses 22 which extends along the axle assembly 19 through the radially extending pipe 31 and along the hose 13 to be coupled to the outlet of the pump motor 21 whilst a similar hose 22 extends from the inlet of the pump motor 21 to the fitting 58. Thus fluid introduced into the fitting 60 in the end cap 59 will pass along the passage 54 and to the pump motor 21 whilst exhaust fluid from the motor 21 will pass into the fitting 57 through the passage 56 for exit through the fitting 61.

Figure 6:
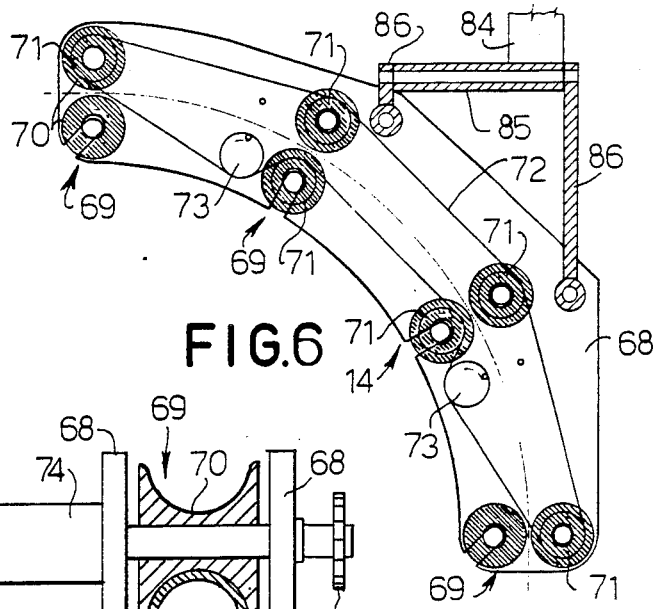
FIG. 6 illustrates details of the rollers of the driven roller assembly and the suspension therefor.
Figure 7:
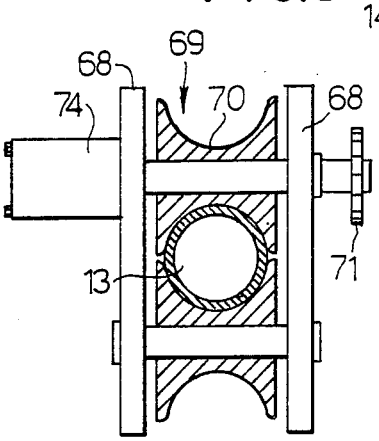
FIG. 7 is an enlarged view along lines A—A of FIG. 1 showing details of the rollers and their engagement with the hose.

The flexible hose 13 passes from the hose reel 12 through the driven roller assembly 14 to be connected to the pump assembly 15. The driven roller assembly 14 is operative to unwind the hose from the reel or wind up the hose and to turn the hose through 90° for passage to and from the bore hole. Referring to FIGS. 6 and 7, the driven roller assembly 14 includes a pair of spaced side plates 68 which support therebetween respective pairs of roller sets 69, in this instance four, with each roller 70 having a concave outer surface to co-operate with the other roller in each set and neatly engage about the hose 13. One roller 70 in each end set together with both rollers 70 in the other two sets are provided with sprockets 71 outside of the side plates 68 about which an endless chain 72 is looped. Idler sprockets 73 are provided to maintain chain tension. An hydraulic motor 74 is coupled to the upper roller 70 in the first set so that drive is transmitted to the ro11er sets 69 via the endless chain 72. Actuation of the hydraulic motor 74 in one direction will cause the hose 13 to be unwound from the hose reel 12 to lower the pump assembly 15 into the ground bore. Similarly, rotation of the hydraulic motor 74 in the opposite direction will enable the pump assembly 15 to be raised and the hose 13 to be wound onto the reel 12. As shown in FIG. 6, the roller sets 69 are positioned along an arc preferably of such a radius that they direct the centre line of the hose 13 along an arc having the same or substantially the same radius as the radius of the cylindrical member 27 of the reel 12 so that kinking of the hose 13 is avoided.

Figure 8:
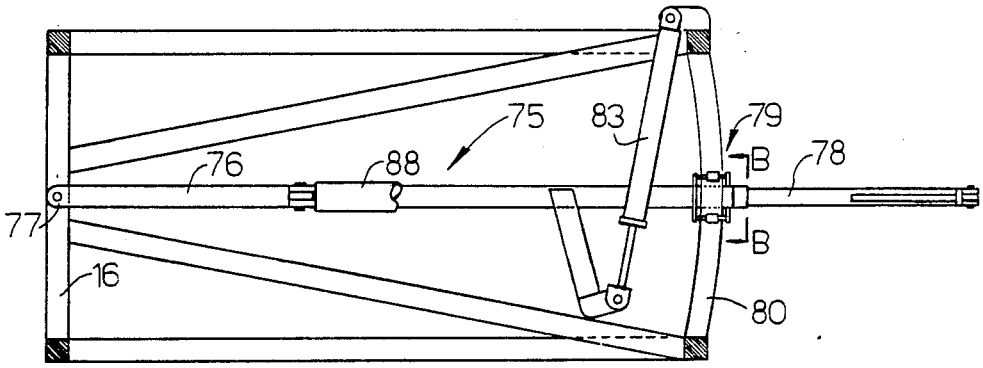
FIG. 8 is a plan view showing the extension arm assembly which supports the driven roller assembly.
Figure 9:
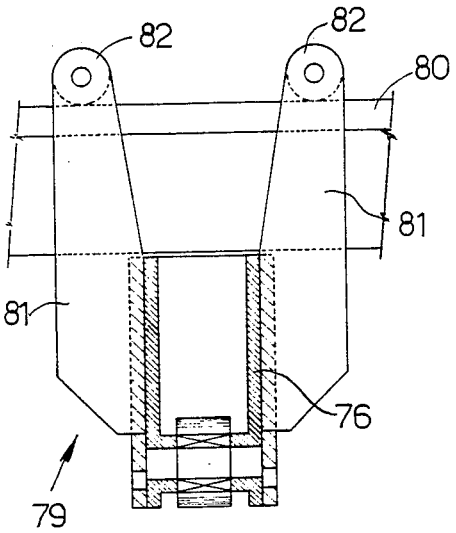
FIG. 9 is a sectional view along lines B—B of FIG. 8 showing details of the carriage assembly for the extension arm assembly.

The drive roller assembly 14 is supported at one end of a support arm assembly 75 (see FIGS. 1 and 8) which comprises a first hollow member 76 fixed pivotally at 77 to the end frame 16 for pivotal movement about a vertical axis and a second member 78 telescoped therein. As shown in FIG. 9, the opposite end of the member 76 is supported by a carriage assembly 79 on a transversely extending arcuate track 80 so as to be supported during its transverse movement. Preferably, the arcuate track 80 is of generally T-shape cross-section and the carriage assembly includes respective arms 81 disposed on opposite sides of the track 80 supporting rotatably at their upper ends bearings 82 which ride upon the track and at their lower ends the hollow member 76. A ram 83 extends between a lug on the frame member 17 and a lug attached to the hollow member 76 so as to pivot the hollow member 76 about its vertical pivot axis and to move the carriage assembly 79 along the track 80 in any desired direction.

The second member 78 is preferably supported by means of bearings within the hollow member 76 for smooth inward and outward sliding movement and is provided at its free end with a downwardly extending member 84 which supports the roller assembly 14 for transverse pivotal movement. For this purpose, a hollow bar 85 is fixed to the downwardly extending member to support a pair of hangers 86 which are fixed between the side support plates 68 of the roller assembly 14 and which are mounted to the hollow bar via an elongated bolt 87 so that the hangers are free for pivotal movement from side to side about the axis of the hollow member.

A further hydraulic ram 88 extends between lugs fixed to the first and second members 76 and 78 respectively so that the second member 78 may be extended or retracted as desired to place the drive roller assembly 14 and pump assembly 15 in alignment with the bore. This may also be achieved by extension or retraction of the hydraulic ram 83.

Figure 10:
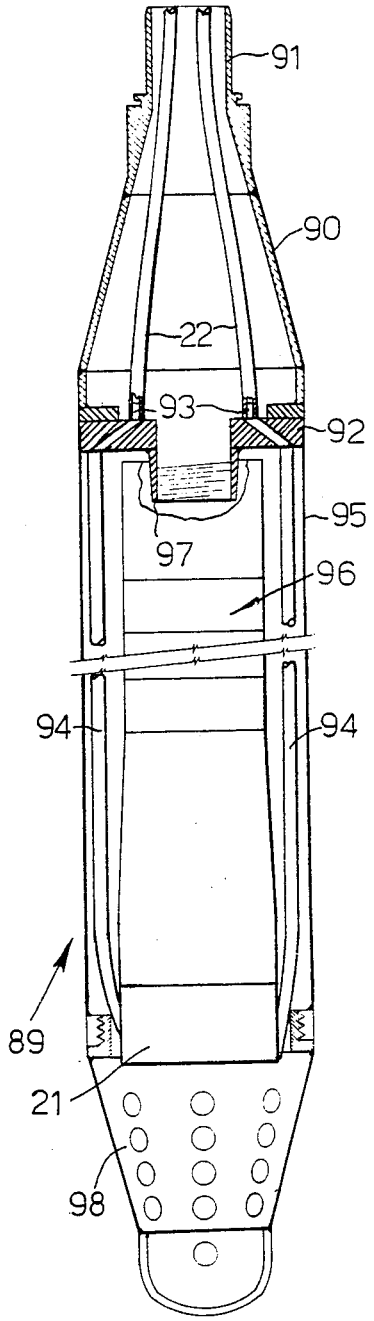
FIG. 10 illustrates in part sectional view the pump shroud assembly.

Referring now to FIG. 10, there is illustrated the pump shroud and suction cover assembly 89 which includes a frusto conical discharge portion 90 which tapers to a tubular end 91 which engages with the end of the hose 13 and is clamped thereto by means of a clamp assembly similar to that shown in FIGS. 3 and 4. The frusto conical discharge portion 90 is fixed to a pump discharge adapter plate 92 which is provided with fittings 93 on either side for coupling to the hydraulic motor supply and discharge lines 22 and further supply and discharge lines 94. The plate 92 also carries a cylindrical shroud 95 in which is located the submersible pump 96. The pump 96 which in this instance comprises a ten stage SP16 Grundfos Pump has its outlet coupled to a sleeve 97 of the pump discharge adapter 92 whilst the lower end thereof is coupled to the pump motor 21. The lower end of the shroud 95 as shown is provided with a frusto conical perforated hood 98 which is operative to prevent large solids passing to the pump 96.

In use, the pump set 10 may be supported say on the tray of a truck or the like and driven to the required site whereafter the rams 83 and 88 may be actuated to position the pump assembly 15 over the bore hole. When the pump assembly 15 is aligned with the bore hole, the driven roller motor 74 is actuated together with the reel motor 30 so that the hose 13 is unwound and the pump assembly 15 lowered into the bore hole. For this purpose, the hydraulic motors of the driven roller assembly 14 and the hose reel 12 are coupled via a valve to a pressurized source so that when the pump assembly 15 is being lowered into the bore hole, full pressure is applied to the roller assembly motor 74 and less pressure to the reel motor 30 so that the hose 13 is somewhat pulled from the reel. When the pump assembly 15 is submerged, hydraulic fluid is supplied through the gland assembly 20 and pipes 22 and 94 to the pump motor 21 to cause operation of the pump 96 whereafter water or liquid from the bore hole passes upwardly through the hose 13 and about the hydraulic fluid pipes 22 through the radial pipe 31 and into the axle assembly 19 for discharge through the open end 19' thereof which may be connected to a discharge hose. When the pumping has been completed, the hydraulic supply to the motor 21 is stopped and the reel motor 30 and roller motor 74 actuated to wind in the hose. In this instance, full pressure is applied to the reel motor 30 with less pressure to the roller motor 74. During winding up of the hose, the ram 83 may be actuated to move the driven roller assembly 15 from side to side to ensure smooth passage of the hose 13 onto the reel 12.

The present invention therefore provides an effective apparatus for removing water or other liquid from bore holes, foundation holes, blast holes or other situations. The apparatus may be also used for pumping slurries or sewerage pumping and thus the term "liquid" used throughout the specification and claims includes slurries. The drive roller means 14 acts as an effective guide for guiding the pump and pipe down the bore hole and permits the use of a flexible plastics pipe such as that commonly known as Polypipe. Furthermore as the hydraulic lines 22 are disposed within the discharge conduit 13, excessive build-up of heat within the lines 22 will be eliminated due to the cooling effect of the discharged liquid which in use substantially surrounds the lines 22.

Of course, it will be realised that many variations may be made to the above embodiment without departing from the spirit and scope of the invention. For example, the hydraulic drive motors may be replaced by other equivalent arrangements whilst the hydraulic rams 83 and 88 may be substituted by manually operable means or any other extension arrangement. The present invention provides an efficient clamping assembly for clamping the end of the hose of a fitting. This clamp assembly may be applied to any equivalent hose clamping application. Finally, this invention provides an efficient gland assembly for transferral of hydraulic fluid between rotating parts.

I claim:

1. Apparatus for removing water or other liquid from a bore hole or the like, said apparatus including a reel assembly, flexible discharge conduit means wound about said reel assembly, said conduit means being connected at its free end to submersible pump means, means for mounting said reel assembly for rotation so that said pump means and conduit means may be lowered into said bore hole or raised therefrom and there being provided a roller assembly operatively engaged with said conduit means and adapted to guide said conduit means between said reel assembly and said bore hole, said reel assembly including a plurality of pairs of diametrically opposed rollers, the rollers of each said pair having a concave outer surface conforming substantially to the outer surface of said conduit means, the rollers in each said pair cooperating to substantially surround said conduit means so as to circumferentially support said conduit means, said pairs of rollers being arranged along an arc to deflect said conduit means from said reel assembly and align said conduit means with said bore hole, drive means connected to at least one roller in each said pair of rollers, said drive means being operative to cause rotation of said rollers in a direction to assist in unwinding said conduit means from said reel assembly for lowering said pump assembly and said conduit means into said bore hole.

2. Apparatus according to claim 1 wherein there are provided at least four pairs of said rollers and wherein at least the outer rollers in each said pair of rollers are connected to said drive means.

3. Apparatus according to claim 1 wherein there are provided at least four pairs of said rollers and wherein the outer rollers of each end pair of said rollers and both rollers of the intermediate pairs of rollers are connected to said drive means.

4. Apparatus according to claim 1 wherein said drive means includes endless flexible link means and there being provided a drive motor operable through said link means to cause rotation of said rollers.

5. Apparatus according to claim 1 wherein said roller assembly is supported forwardly of said reel assembly for movement towards and away therefrom to position said pump means in alignment with said bore hole.

6. Apparatus according to claim 5 wherein said reel assembly is supported for rotational movement about a substantially horizontal axis on a frame assembly and wherein said roller assembly is supported on said frame assembly by an extension arm assembly arranged in use to be adjustable to move said roller assembly inwardly and outwardly relative to said frame assembly.

7. Apparatus according to claim 6 wherein said extension arm assembly is supported on said frame assembly for pivotal movement about a substantially vertical axis and there being provided means for pivoting said extension arm assembly about said axis to thereby move said roller assembly laterally.

8. Apparatus according to claim 7 wherein said roller assembly is supported at the leading end of said extension arm assembly for transverse pivotal movement about a substantially horizontal axis.

9. Apparatus for removing water or other liquid from a bore or the like, said apparatus including a reel assembly, flexible discharge conduit means wound about said reel assembly, said conduit means being connected at its free end to submersible pump means, means for mounting said reel assembly for rotation so that said pump means and conduit means may be lowered into said bore hole or raised therefrom, and there being provided a roller assembly operatively engaged with said conduit means and adapted to guide said conduit means between said reel asembly and said bore hole, said roller assembly including a plurality of pairs of diametrically opposed rollers, the rollers of each said pair having a concave outer surface conforming substantially to the outer surface conforming substantially to the outer surface of said conduit means, the rollers in each said pair cooperating to substantially surround said conduit means so as to circumferentially support said conduit means, said pairs of rollers being arranged along an arc to deflect said conduit means from said reel assembly and align said conduit means with said said bore hole, drive means coupled to at least some of said rollers to cause rotation thereof in a direction to assist in unwinding said conduit means from said reel assembly, hydraulic motor means operatively coupled to said pump means to drive said pump means so that water or other liquid in said bore hole may be delivered by said pump means into said conduit means for passage therealong and discharge, and there being provided hydraulic fluid supply and exhaust pipes coupled to said hydraulic motor means, said pipes being arranged within said discharge conduit means and extending therealong so that hydraulic fluid in said supply and exhaust pipes is subject to the cooling effect of water or other liquid flowing through said conduit means.

* * * * *